US008141203B2

(12) United States Patent
Ashbee

(10) Patent No.: US 8,141,203 B2
(45) Date of Patent: Mar. 27, 2012

(54) FLOOR TOOL FOR A SURFACE TREATING APPLIANCE SUCH AS A VACUUM CLEANER

(75) Inventor: Giles Ashbee, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 363 days.

(21) Appl. No.: 12/520,812

(22) PCT Filed: Nov. 29, 2007

(86) PCT No.: PCT/GB2007/004548

§ 371 (c)(1),
(2), (4) Date: Jul. 31, 2009

(87) PCT Pub. No.: WO2008/078063

PCT Pub. Date: Jul. 3, 2008

(65) Prior Publication Data

US 2010/0011534 A1 Jan. 21, 2010

(30) Foreign Application Priority Data

Dec. 22, 2006 (GB) ..... 0625804.0

(51) Int. Cl.
*A47L 9/02* (2006.01)
*A47L 5/34* (2006.01)

(52) U.S. Cl. ..... 15/415.1; 15/354; 15/359; 15/361

(58) Field of Classification Search ..... 15/15.1, 15/354, 359, 361
See application file for complete search history.

(56) References Cited

U.S. PATENT DOCUMENTS

| | | | | |
|---|---|---|---|---|
| 4,564,972 | A * | 1/1986 | Varin | 15/358 |
| 2005/0055798 | A1 * | 3/2005 | Bagwell et al. | 15/415.1 |
| 2005/0262658 | A1 | 12/2005 | Conrad et al. | |
| 2010/0058554 | A1 * | 3/2010 | Ashbee | 15/415.1 |

FOREIGN PATENT DOCUMENTS

| | | |
|---|---|---|
| DE | 3009648 | 9/1981 |
| EP | 0125994 | 11/1984 |
| EP | 0304609 | 3/1989 |

(Continued)

OTHER PUBLICATIONS

The Written Opinion of the International Searching Authority mailed on Jun. 6, 2008 directed towards international application No. PCT/GB2007/004573; 6 pages.
International Search Report mailed on Jun. 6, 2008 directed towards international application No. PCT/GB2007/004573; 2 pages.
Ashbee, G., U.S. Office Action mailed Apr. 13, 2011 directed to U.S. Appl. No. 12/520,807; 8 pages.

(Continued)

*Primary Examiner* — Bryan R Muller
(74) *Attorney, Agent, or Firm* — Morrison & Foerster LLP

(57) ABSTRACT

A floor tool for a cleaning appliance includes a head engaging with a floor surface, a connecting arm pivotally connected to the head about a first axis and a supporting body pivotally connected to the head about a second axis. The head includes a suction opening which lies in a suction plane, and the connecting arm includes an outlet in communication with the suction opening and adapted to connect to the cleaning appliance. The first and second axes lie parallel to one another in a plane which is substantially parallel to the suction plane. By providing a pair of parallel axes which lie in a plane parallel to the suction plane, the floor tool can have a reduced depth while still being able to achieve the desired "rocking" motion to improve cleaning performance. The height of the floor tool can thus be minimized.

12 Claims, 6 Drawing Sheets

FOREIGN PATENT DOCUMENTS

| | | |
|---|---|---|
| EP | 0353546 | 2/1990 |
| GB | 2391459 | 2/2004 |
| GB | 2402047 | 12/2004 |
| WO | WO-02/26098 | 4/2002 |
| WO | WO-03/039315 | 5/2003 |

OTHER PUBLICATIONS

International Preliminary report on Patentability dated Feb. 3, 2009 directed at counterpart application No. PCT/GB2007/004548; 8 pages.

International Search Report mailed Mar. 20, 2008 directed to corresponding international application No. PCT/GB2007/004548; 5 pages.

GB Search Report, dated Mar. 28, 2007 directed to corresponding GB application No. GB0625804.0; 1 page.

Written Opinion directed to counterpart international application PCT/GB2007/004548; 6 pages.

Ashbee, U.S. Office Action mailed Sep. 22, 2011, directed to U.S. Appl. No. 12/520,807; 9 pages.

* cited by examiner

FLOOR TOOL FOR A SURFACE TREATING APPLIANCE SUCH AS A VACUUM CLEANER

REFERENCE TO RELATED APPLICATIONS

This application is the national stage under 35 USC 371 of International Application No. PCT/GB2007/004548, filed Nov. 29, 2007, which claims the priority of United Kingdom Application No. 0625804.0, filed Dec. 22, 2006, the entire contents of both of which prior applications are incorporated herein by reference.

FIELD OF THE INVENTION

The invention relates to a floor tool for a surface treating appliance. Particularly, but not exclusively, the invention relates to a floor tool for a vacuum cleaner.

BACKGROUND OF THE INVENTION

A wide range of vacuum cleaners is available on the market and includes upright cleaners, cylinder cleaners and hand-held cleaners. A cylinder vacuum cleaner normally has a main body containing a motor and fan assembly for drawing an airflow into the main body and separating apparatus for separating dirt and dust from the airflow. The separating apparatus may take the form of, for example, a cyclonic separator, a bag or a filter. A hose and wand assembly is connected to the main body and a cleaning tool is attached to the end of the wand remote from the main body so that the cleaning tool can be maneuvered across the surface to be cleaned. A range of cleaning tools is often supplied so that a user can choose an appropriate tool for their cleaning task; for example a crevice tool or a brush tool. For general on-the-floor cleaning a cylinder vacuum cleaner is provided with a floor tool.

Many upright vacuum cleaners are provided with releasable hoses or wands so that they are able to operate in the manner of a cylinder machine. Floor tools are thus often provided with upright machines as well.

Floor tools generally have a head which engages with a floor surface. The head has a lower surface, commonly known as a soleplate. A suction opening is formed in the soleplate through which, in use, dirt and dust is drawn into the floor tool from the floor surface. It is useful for the head (or sometimes just the soleplate) to be pivotally connected to the remainder of the floor tool so that the head or soleplate can rock back and forth as the floor tool is pushed and pulled across the floor surface. The rocking motion allows the suction opening to remain in close proximity to the floor surface when the floor tool is pushed or pulled across the floor surface, preventing the soleplate from lifting away from the floor surface and reducing "skipping" of the floor tool. The rocking motion is particularly advantageous on carpeted surfaces because the rocking motion can cause parts of the soleplate to agitate the carpet. An example of this kind of floor tool is shown in WO 02/26098.

Further arrangements illustrating floor tools with pivoted soleplates are shown in EP 0353546, EP 0304609 and WO 03/039315. EP 0353546 discloses a floor tool which has a set of floor-engaging wheels and a soleplate. The duct connecting the head to the wand has a pivot point located directly above the axis of the wheels so that, when a user pushes forward on the wand, a downwardly-acting moment about the axis of the wheels pushes the soleplate onto the floor surface. EP 0304609 discloses a floor tool having a complicated arrangement of pivots which forces the head of the floor tool to rock back and forth when the floor tool is pushed back and forth across a floor surface. WO 03/039315 discloses a floor tool having a connecting duct which is pivoted in two locations relative to the soleplate. This prevents the soleplate from being lifted away from the floor surface on the backstroke of a cleaning motion.

In order to operate effectively, the above arrangements all require pivot points which are located some distance above the soleplate. This is required so that a sufficiently large moment is produced to act on the soleplate to allow the soleplate to move without undue effort from the user. However, a disadvantage of such arrangements is that the floor tool can have a significant depth. Consequently, a user cannot use the known floor tools to clean under low surfaces such as, for example, low furniture or cupboards.

SUMMARY OF THE INVENTION

It is therefore an object of the present invention to provide a floor tool which is capable of providing good cleaning efficiency but which has a low profile and is able to clean under low surfaces. It is a further object of the present invention to provide a floor tool which has a head which is able to pivot easily relative to the remainder of the floor tool without requiring a large vertical spacing between a pivot point and the soleplate.

According to the invention, there is provided a floor tool for a surface treating appliance comprising a head for engaging with a floor surface, a connecting arm pivotally connected to the head about a first axis and a supporting body pivotally connected to the head about a second axis, the head including a suction opening which lies in a suction plane and the connecting arm including an outlet in communication with the suction opening and adapted to connect to the appliance, wherein the first and second axes are spaced from one another and lie parallel to one another in a plane which is substantially parallel to the suction plane.

By providing a pair of parallel axes which lie in a plane parallel to the suction plane, the floor tool can have a reduced depth whilst still being able to achieve the desired "rocking" motion to improve cleaning performance. By placing the axes in a plane parallel to the plane of the suction opening, the height of the floor tool can be minimised.

Preferably, the floor tool further comprises a fulcrum located on the supporting body, the connecting arm being adapted and arranged to pivot about the fulcrum. More preferably, pivoting of the connecting arm about the fulcrum causes the first axis to move relative to the second axis such that the head is rotated relative to the supporting body. By providing such an arrangement, the floor tool can be arranged so that a downward force on the connecting arm relative to the floor surface translates into an upward force acting upon the head. This allows the head to be rocked easily in an appropriate direction when pushed forwardly during a cleaning operation.

Preferably, the supporting body has a channel for receiving the connecting arm. More preferably, the fulcrum is located in the channel. By providing a channel for the connecting arm, the connecting arm can be recessed into the supporting body, reducing the profile of the floor tool. By providing the fulcrum in the channel, the head can be rocked forward when the connecting arm is recessed into the supporting body.

Preferably, the connecting arm comprises first and second parts which are pivotally connected about a third axis. By providing a pivotal connection between the first and second parts of the connecting arm, a greater range of movement of the connecting arm is possible whilst still maintaining the head of the floor tool on the floor surface.

Preferably, the supporting body comprises at least one wheel or roller for supporting a part of the floor tool on the floor surface, and the third axis is co-axial with the axis of the at least one wheel or roller when the connecting arm is in contact with the fulcrum. By providing such an arrangement, manipulation of the floor tool will result in an even transfer of force to the floor tool, preventing the floor tool from becoming unbalanced in use.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines and shampooing machines.

BRIEF DESCRIPTION OF THE DRAWINGS

Embodiments of the invention will now be described with reference to the accompanying drawings, in which.

DETAILED DESCRIPTION OF THE INVENTION

Figure 1:
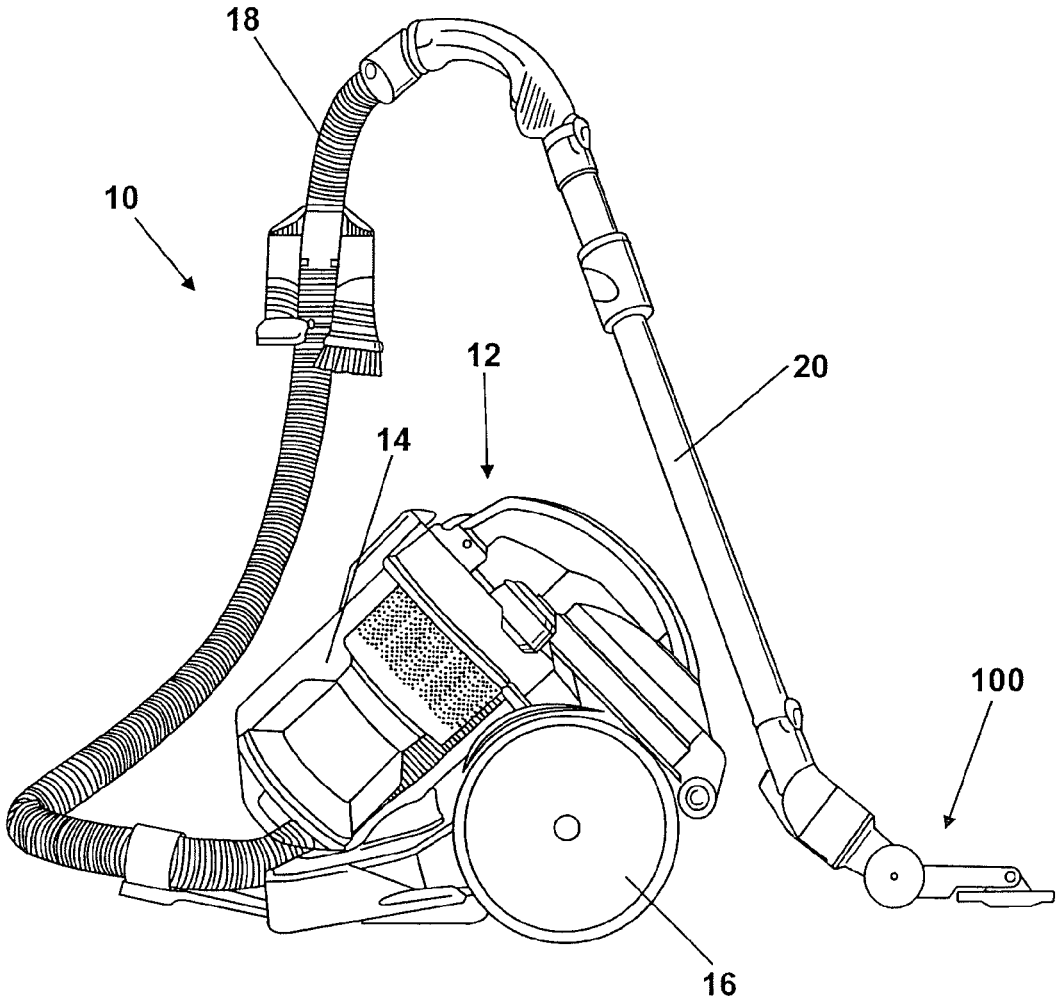
FIG. 1 shows a floor tool according to the present invention attached to a known vacuum cleaner.

FIG. 1 shows an example of a surface treating appliance in the form of a cyclonic cylinder vacuum cleaner. The vacuum cleaner 10 has a main body 12 which includes cyclonic separating apparatus 14 and a pair of wheels 16. The cyclonic separating apparatus 14 takes the form of a low-efficiency upstream cyclone followed by a high-efficiency downstream cyclone. Connected to the main body 12 are a hose 18 and a wand 20. Connected to the end of the wand 20 is a floor tool 100 according to the invention.

In use, a motor and fan unit (not shown) generates an airflow which is drawn into the main body 12 via the wand and hose 20, 18. The airflow then passes into the cyclonic separating apparatus 14. In the cyclonic separating apparatus 14, the upstream cyclone separates larger particles of dirt and dust from the airflow before the airflow is passed to the downstream cyclone which separates smaller particles of dirt and dust from the airflow. The cleaned airflow then passes sequentially through a pre-motor filter (not shown), the motor and fan unit and a post-motor filter (not shown) before being exhausted from the main body 12. In order to clean a floor, the user grips the top end of the wand 20 and manoeuvres the floor tool 100 across the floor surface. The main body 12 of the vacuum cleaner 10 is able to move across the floor surface on the pair of wheels 16 and is dragged along by the hose 18 as a user moves around the room. The above details are not material to the present invention which is concerned only with the floor tool 100.

Figure 2:
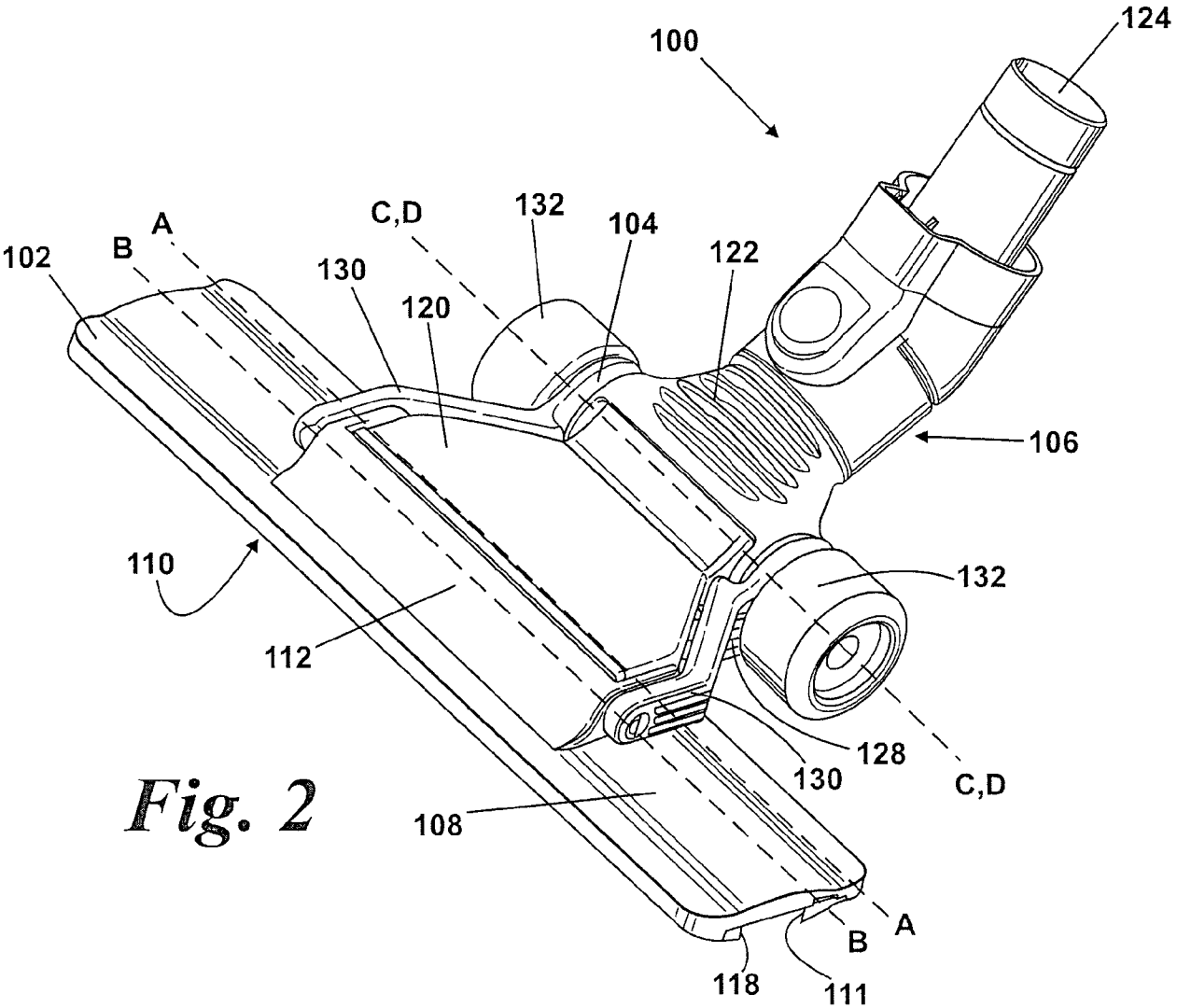
FIG. 2 is an enlarged perspective view of the floor tool according to the present invention in a first configuration.
Figure 3:
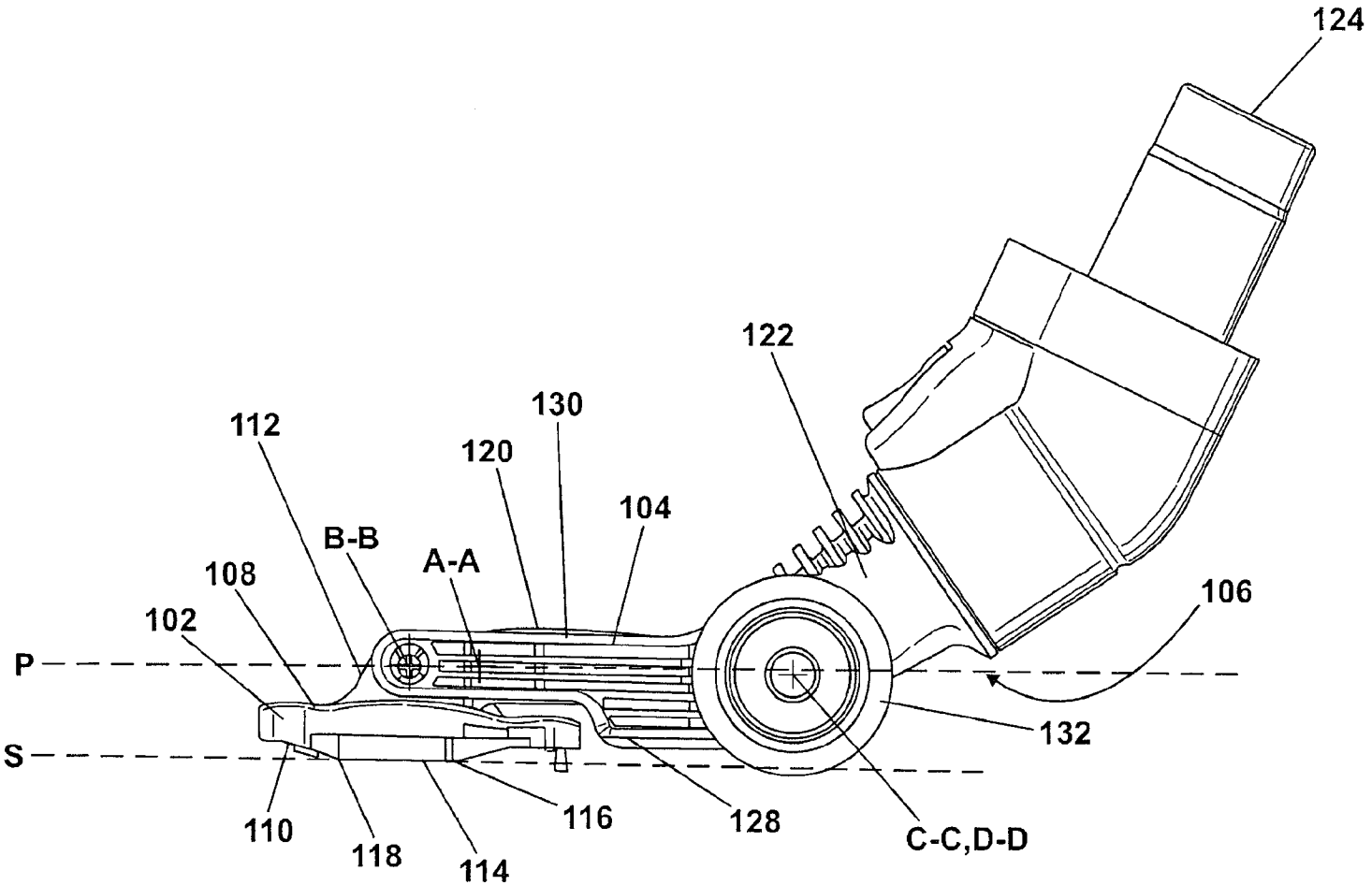
FIG. 3 is a side view of the floor tool of FIG. 2.

FIGS. 2 and 3 show the floor tool 100 in more detail. In FIGS. 2 and 3, the floor tool 100 is shown in a first configuration. The floor tool 100 includes a head 102, a supporting body 104 and a connecting arm 106. The connecting arm 106 is pivotally connected to the head 102 about a first axis A-A. The supporting body 104 is pivotally connected to the head 102 about a second axis B-B. The first and second axes A-A, B-B lie parallel to one another and both lie in a plane P (shown in FIG. 3).

The head 102 includes an upper surface 108 and a soleplate 110. A raised portion 112 is located centrally on the upper surface 108 of the head 102. The raised portion 112 includes two pivots, one defining the axis A-A about which the connecting portion 106 is connected to the head 102, and the other defining the axis B-B about which the supporting body 104 is connected to the head 102. The pivots are in a fixed relationship to the head 102 and move with the head 102 when the head is rotated.

The soleplate 110 faces the floor surface in use and includes a suction opening 114. The suction opening 114 is defined by the lower edges of side walls 116, 118. The lower edges of the side walls 116, 118 define a suction plane S (FIG. 3). The suction plane S lies parallel to the plane P. In other words, the plane P in which the axes A-A, B-B lie is parallel to the suction plane S in which the suction opening 114 lies. Since the pivot points about the axes A-A, B-B are fixed to the head 102, the plane P in which they lie is in a fixed relationship to the suction plane S in which the suction opening 114 lies.

The connecting arm 106 comprises a first part 120 and a second part 122. The first part 120 is pivotally connected to the head 102. The second part 122 is pivotally connected to the first part 120 about a third axis C-C. The second part 122 includes an outlet 124 which is adapted to be connectable to the wand or hose 20, 18 of the vacuum cleaner 10. The outlet 124 communicates with the suction opening 114 by way of a suction conduit 126 which is formed in the interior of the connecting arm 106. The suction conduit 126 can be seen in FIGS. 4 and 5.

The supporting body 104 includes a base 128 and is pivotally connected to the head 102 by means of a pair of spaced-apart arms 130. The spaced-apart arms 130 extend from the pivot defining the second axis B-B and pass over the upper surface 108 of the head 102 either side of the raised portion 112 and meet the base 128 at the rear of the head 102. The base 128 and the spaced-apart arms 130 form a channel into which the first part 120 of the connecting arm 106 is recessed when in the first configuration. This is shown in FIG. 2.

A pair of wheels 132 is located at the rear end of the supporting body 104. The wheels 132 are arranged to support the floor tool 100 on the floor surface and are rotatably mounted on the supporting body 104 about a fourth axis D-D. In the first configuration, the third axis C-C about which the first and second parts 114, 116 are pivotally connected is coincident with the fourth axis D-D of the pair of wheels 132 (see FIG. 3).

Figure 4:
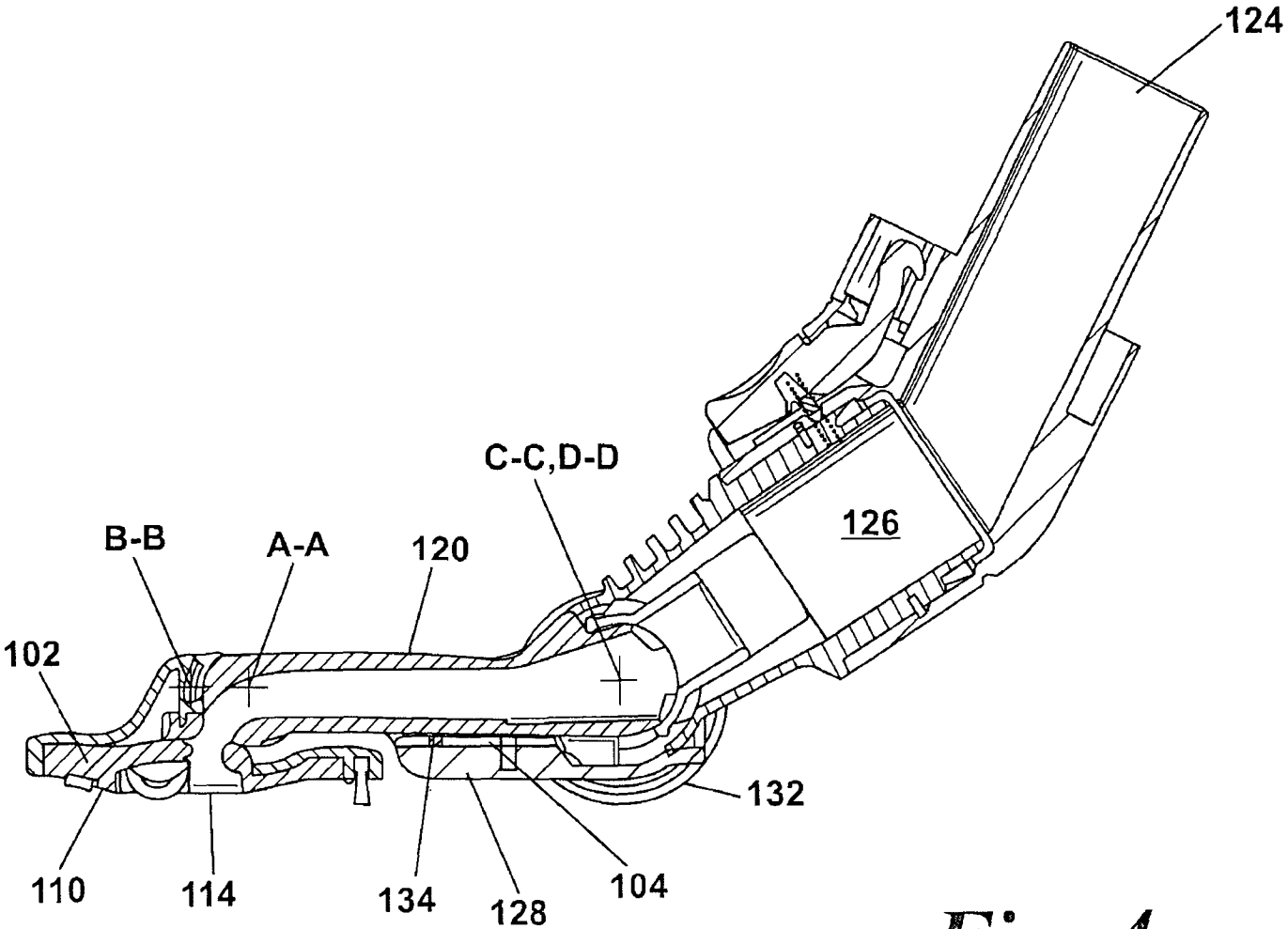
FIG. 4 is a section through the floor tool of FIG. 2.
Figure 5:
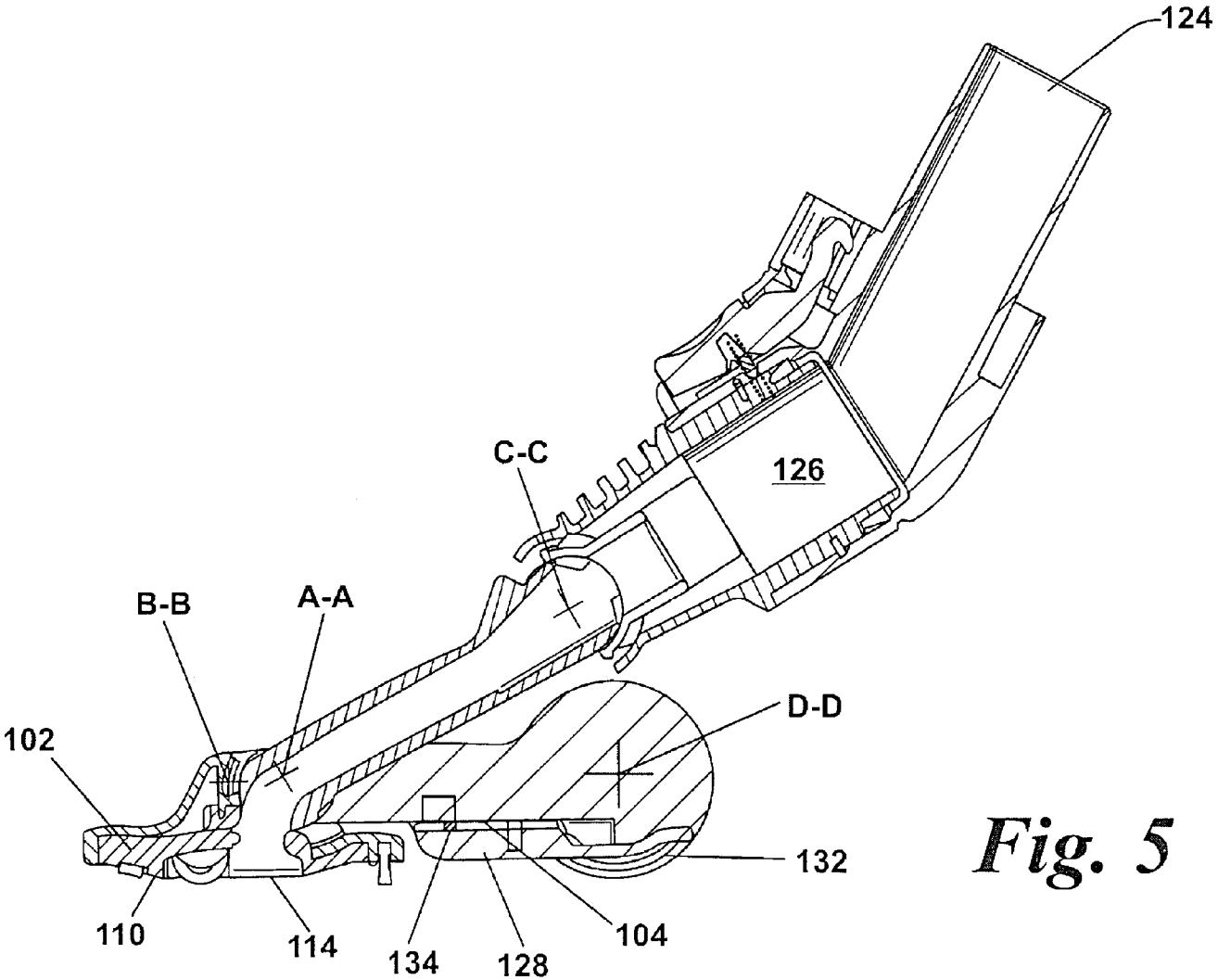
FIG. 5 is a section through the floor tool of FIG. 2 showing the floor tool in a second configuration.

FIGS. 4 and 5 are sections through the floor tool 100. In FIG. 4, the floor tool 100 is shown in the first configuration. The floor tool 100 will be in the first configuration when it is pushed forwards across the floor surface. In the first configuration, the first part 120 of the connecting arm 106 is in a lowered position.

A fulcrum 134 is formed on an upper face of the base 128 within the channel. When the first part 120 of the connecting arm 106 is in the lowered position, the first part 120 abuts and rests on the fulcrum 134. When, in use, a user applies a force to the floor tool 100 in order to push the floor tool 100 forwardly across a floor surface, the first part 120 is able to pivot about the fulcrum 134. The part of the connecting arm 106 rearwardly of the fulcrum 134 then moves downwards relative to the floor surface, and the part of the connecting arm 106 forwardly of the fulcrum 134 moves upwards relative to the floor surface.

The floor tool 100 is shown in a second configuration in FIG. 5. The floor tool 100 will be in the second configuration when it is pulled backwards across the floor surface. In the second configuration, the first part 120 of the connecting arm 106 is shown in a raised position. The movement of the first part 120 of the connecting arm 106 helps to maintain the suction opening 114 in contact with the floor surface when the floor tool 100 is pulled backwards. This is because it is common for a user to make a slight upward movement when pulling the floor tool 100 backwards and the movement of the first part 120 reduces the likelihood of the floor tool 100 being lifted away from the floor surface.

Figure 6:
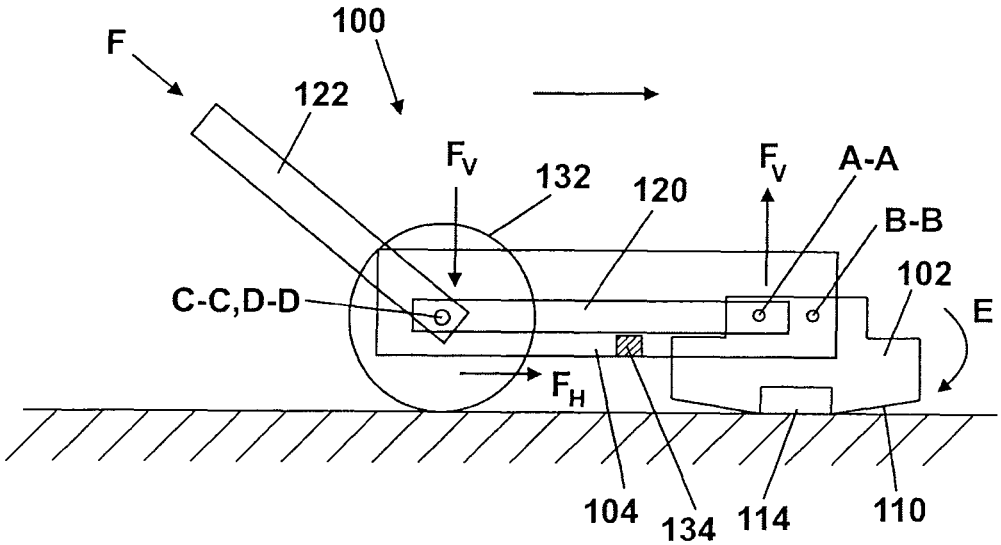
FIG. 6 is a schematic side view of the floor tool of FIG. 2 in the first configuration when being pushed in a forward direction.
Figure 7:
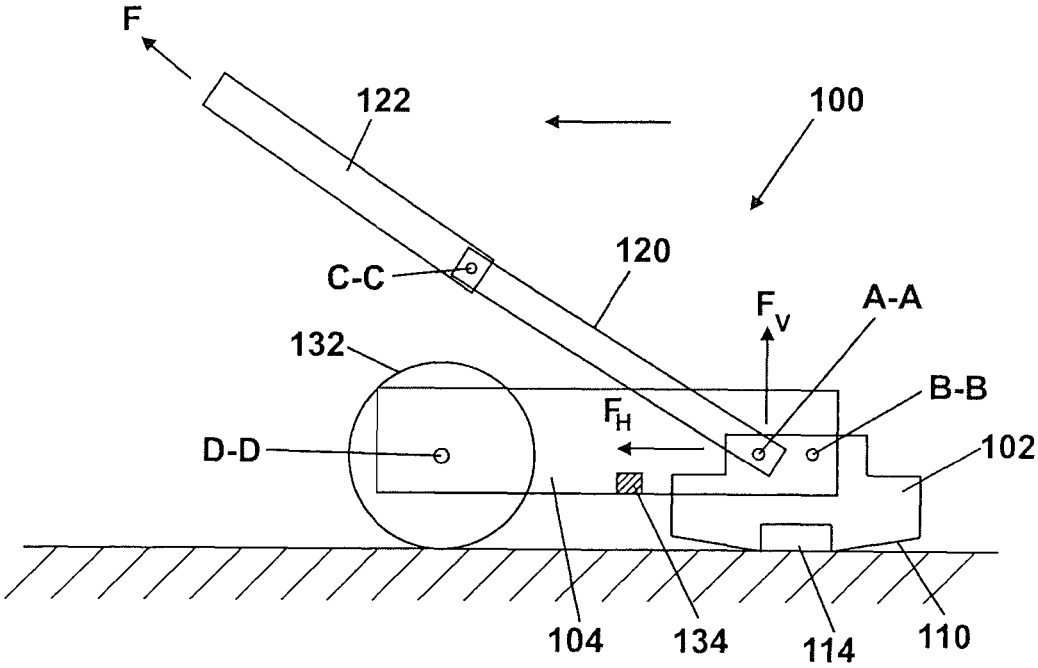
FIG. 7 is a schematic side view of the floor tool of FIG. 2 in the second configuration when being pulled in a rearward direction.

In use, the floor tool 100 is attached to the mouth of the wand 20. The vacuum cleaner 10 draws a flow of air through the suction opening 114, into the wand 20 and into the main body 12 of the vacuum cleaner 10 via the hose 18. The user manipulates the end of the wand 20 to push and pull the floor tool 100 across the floor surface in order to clean it. FIGS. 6 and 7 are schematics to show the configuration of the floor tool 100 in use.

FIG. 6 shows a schematic of the floor tool 100 in the first configuration when it is being pushed forwardly. In this configuration, the user applies a force F to the wand 20, which acts through the second part 122 of the connecting arm 106. The force F acts on the pivot point about the third axis C-C. The force F can be resolved into a horizontal component, $F_H$ and a vertical component $F_V$. The horizontal component $F_H$ of the force F will cause the floor tool 100 to move forwardly across the floor surface. The vertical component $F_V$ of the force F acts downwardly on the pivot point about the third axis C-C, causing that end of the first part 120 of the connecting arm 106 to move downwardly towards the floor surface. Since the fulcrum 134 is located approximately mid-way between the third axis C-C and the first axis A-A, the other end of the first part 120 forward of the fulcrum 134 moves upwardly away from the floor surface. When this happens, the first axis A-A will move upwardly away from the floor surface, causing the head 102 to rotate about the second axis B-B in the direction shown by the arrow E in FIG. 6.

Therefore, when a user pushes the wand 20 and cleaner head 102 forwardly across a floor surface, the arrangement of the floor tool 100 is such that the head 102 will be rotated in the direction of the arrow E, causing the front of the head 102 to be forced down into the floor surface. This "diving" action of the head 102 improves cleaning performance and reduces the risk of skipping of the floor tool 100 across the floor surface.

FIG. 7 shows the floor tool 100 in the second configuration when it is being pulled rearwardly. In this configuration, the user applies a force F to the wand. The force F can be resolved into a horizontal component, $F_H$ and a vertical component $F_V$. The horizontal component $F_H$ of the force F will cause the floor tool 100 to move rearwardly across the floor surface. The vertical component $F_V$ of the force F acts upwardly on the pivot point about the third axis C-C, causing the first part 120 of the connecting arm 106 to rotate upwardly about the first axis A-A. This movement allows the wand 20 to be lifted slightly when pulling the floor tool 100 backwards across the floor surface without the floor tool 100 being pulled away from the floor surface.

The invention is not limited to the detailed description given above. Variations will be apparent to the person skilled in the art. For example, the fulcrum need not be located on the supporting body. What is important is that the fulcrum is located between the connecting arm and the supporting body. Therefore, it may be located, for example, on the connecting arm or on a separate member located between the connecting arm and the supporting body. Additionally, the plane in which the first and second axes lie need not be exactly parallel to the suction plane in order to achieve the effect of the invention, and instead may be close to parallel.

The suction plane need not be defined by the edges of a pair of side walls. The suction opening may comprise, for example, a hole formed in a plate, in which case the plane of the plate will define the suction plane. Additionally, a plurality of suction openings may be provided. What is important is that at least one of the suction openings lies in a plane which is parallel to the plane in which the first and second axes lie.

The third axis of the connecting arm need not be coincident with the fourth axis of the wheel arrangement at any point. Further, the connecting arm need not be formed in two sections. A single piece connecting arm could be used or further sections may be introduced.

The wheel arrangement need not comprise a pair of wheels. A single wheel may be provided. Alternatively, a rolling support member having a continuous support surface may be used to improve manoeuvrability of the floor tool.

The floor tool may also be used in a variety of cleaning appliances, for example carpet sweepers, vacuum cleaners, industrial suction devices or tank vacuums. If the floor tool is to be used with a domestic vacuum cleaner, any suitable type of vacuum cleaner may be used, for example upright vacuum cleaners, cylinder vacuum cleaners or stick-vacuum type machines.

The invention claimed is:

1. A floor tool for a surface treating appliance, comprising a head for engaging with a floor surface and comprising a first pivot defining a first axis and a second pivot defining a second axis, a connecting arm pivotally connected to the head about the first axis and a supporting body pivotally connected to the head about the second axis, the head including a suction opening which lies in a suction plane, and the connecting arm including an outlet in communication with the suction opening and adapted to connect to the appliance, wherein the first and second axes are spaced from one another and lie substantially parallel to one another in a plane which is substantially parallel to the suction plane, and wherein the first and second axes are fixed relative to the head as a whole during movement of the head relative to the connecting arm and the supporting body.

2. The floor tool of claim 1, further comprising a fulcrum located on the supporting body, the connecting arm being adapted and arranged to pivot about the fulcrum.

3. The floor tool of claim 2, the head, connecting arm and supporting body being relatively configured so that pivoting of the connecting arm about the fulcrum causes the first axis to move relative to the second axis such that the head is rotated relative to the supporting body.

4. The floor tool of claim 2, wherein the connecting arm is pivotable about the first axis towards and away from the fulcrum.

5. The floor tool of claim 2, wherein the supporting body has a channel for receiving the connecting arm.

6. The floor tool of claim 5, wherein the fulcrum is located in the channel.

7. The floor tool of claim 2, wherein the connecting arm comprises first and second parts which are pivotally connected about a third axis.

8. The floor tool of claim 7, wherein the supporting body comprises at least one wheel or roller for supporting a part of the floor tool on the floor surface, and the third axis is co-axial with the axis of the at least one wheel or roller when the connecting arm is in contact with the fulcrum.

9. The floor tool of claim 1, wherein the connecting arm is configured to carry a fluid flow between the suction opening and the outlet.

10. The floor tool of claim 1, wherein the head is pivotally connected to the supporting body at a position which lies perpendicular to the suction plane between front and back limits of the suction opening.

11. A surface treating appliance including the floor tool of claim 1 comprising:

an appliance body; and a floor tool comprising a head for engaging with a floor surface and comprising a first pivot defining a first axis and a second pivot defining a second axis, a connecting arm pivotally connected to the head about the first axis and a supporting body pivotally connected to the head about the second axis, the head including a suction opening which lies in a suction plane, and the connecting arm including an outlet in communication with the suction opening and adapted to connect to the appliance, wherein the first and second axes are spaced from one another and lie substantially parallel to one another in a plane which is substantially parallel to the suction plane, and wherein the first and second axes are fixed relative to the head as a whole during movement of the head relative to the connecting arm and the supporting body.

12. A vacuum cleaner comprising:

an vacuum cleaner body; and a floor tool comprising a head for engaging with a floor surface and comprising a first pivot defining a first axis and a second pivot defining a second axis, a connecting arm pivotally connected to the head about the first axis and a supporting body pivotally connected to the head about the second axis, the head including a suction opening which lies in a suction plane, and the connecting arm including an outlet in communication with the suction opening and adapted to connect to the appliance, wherein the first and second axes are spaced from one another and lie substantially parallel to one another in a plane which is substantially parallel to the suction plane, and wherein the first and second axes are fixed relative to the head as a whole during movement of the head relative to the connecting arm and the supporting body.

* * * * *